US005284292A

United States Patent [19]

Johnson

[11] Patent Number: 5,284,292

[45] Date of Patent: Feb. 8, 1994

[54] CAN DISPENSER

[76] Inventor: Mark M. Johnson, 3106 Panama, Sioux City, Iowa 51103

[21] Appl. No.: 950,889

[22] Filed: Sep. 25, 1992

[51] Int. Cl.[5] ..... B65D 5/72

[52] U.S. Cl. ..... 229/122.1; 229/19; 206/429

[58] Field of Search ..... 229/122.1, 122, 9, 19, 229/122.2, 913; 206/427, 428, 429, 435; 221/302, 305, 306

[56] References Cited

U.S. PATENT DOCUMENTS

| | | | |
|---|---|---|---|
| 1,436,749 | 11/1922 | Zeschmar . | |
| 1,680,275 | 8/1928 | Albaugh . | |
| 2,258,170 | 10/1941 | Austin et al. . | |
| 3,227,322 | 1/1966 | Cram | 229/122.1 X |
| 3,237,837 | 3/1966 | Vizethann | 229/122.1 X |
| 3,356,279 | 12/1957 | Root | 229/122.1 X |
| 3,858,720 | 1/1975 | Flagler | 229/122 X |
| 4,098,383 | 7/1978 | Carpman | 229/122 X |
| 4,138,052 | 2/1979 | Torigian | 229/122.1 X |
| 4,364,509 | 12/1982 | Holley, Jr. et al. | 229/122.1 X |
| 4,494,689 | 1/1985 | Ilitch | 229/19 X |
| 4,848,589 | 7/1989 | Olson et al. | 229/122.1 X |
| 4,940,190 | 7/1990 | Groves | 229/122 |
| 4,958,734 | 9/1990 | Wood et al. | 206/435 |
| 5,020,719 | 6/1991 | Roth et al. | 229/221 X |

*Primary Examiner*—Allan N. Shoap
*Assistant Examiner*—Christopher McDonald
*Attorney, Agent, or Firm*—Larson and Taylor

[57] ABSTRACT

In combination, a carton housing at least one row of cylindrical articles stacked on their sides one on top of the other, an end of said carton having a lower section capable of forming a discharge opening that allows for lengthwise removal of a cylindrical article, and a member slidably insertable through said opening under the lowermost row of said cylindrical articles, said member having a curved lip at one end for retaining a cylindrical article on discharge, an upwardly projecting first ridge at the other end extending substantially the width of said member and an upwardly projecting second ridge positioned a distance from the curved lip that is slightly larger than the diameter of said cylindrical article and extending substantially the width of said member.

10 Claims, 2 Drawing Sheets

CAN DISPENSER

BACKGROUND OF THE INVENTION

This invention relates to new and useful improvements in cartons housing cylindrical articles such as cans. More particularly, the present invention relates to a novel combination for facilitating the removal of cylindrical articles from cartons housing same.

It is currently common practice to pack cylindrical articles such as cans of beer, soft drinks and the like in six-sided cartons. Of these cartons, the most popular cartons are the six-can or twelve-can packs. The packs normally provide a durable housing for the cans but, in so doing, often render accessibility difficult. Consequently, certain of the carton manufacturers provide a tabbed lower section that can be ripped open to permit easier removal of the cans. Although the intent of carton designers in these instances is to allow removal of the cans from the carton one at a time, it is not unusual and, in fact, quite common to find that the removal of one can is followed by the undesired rolling out of several other cans as well. It only takes a few of these mishaps coupled with the accompanying inconvenience of having to pick up dropped cans to turn the carton upwards so that the opening is on the top side of the carton. Now, while storing the carton in this position avoids the can-dropping problem, it often reintroduces an accessibility problem, particularly where the carton is stored in a crowded refrigerator that offers little removal space for access thereto from the top.

Thus, it is an object of the invention to provide a novel combination which facilitates the removal of cylindrical articles from cartons.

Another method of the invention is to provide a novel combination which permits the removal of cylindrical articles such as cans from a carton housing same, one at a time, without the danger of other articles in the carton falling out.

A further object of the invention is to provide a novel combination which allows the carton to remain stored in a refrigerator until all of the articles in the pack are removed without the necessity of orienting the carton in the refrigerator so that the opening is on the top.

Another object of the invention is to provide a novel combination which enables the removal of cylindrical articles from a carton without actually reaching into the carton.

SUMMARY OF THE INVENTION

These and other objects of the invention are obtained by a combination comprising a carton housing at least one row of cylindrical articles stacked on their sides one on top of the other, an end of said carton having a lower section capable of forming a discharge opening that allows for lengthwise removal of a cylindrical article, and a member slidably insertable through said opening, under the lowermost row of said cylindrical articles, said member having a curved lip at one end for retaining a cylindrical article on discharge, an upwardly projecting first ridge at the other end extending substantially the width of said member and an upwardly projecting second ridge positioned a distance from the curved lip that is slightly larger than the diameter of said cylindrical article and extending substantially the width of said member.

BRIEF DESCRIPTION OF THE DRAWING

The invention will be described below with reference to the drawing wherein.

DETAILED DESCRIPTION OF THE INVENTION

Figure 1:
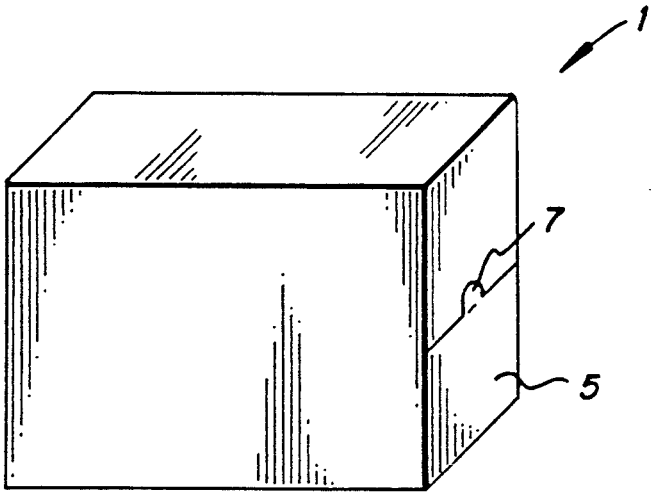
FIG. 1 is a perspective view of a twelve-can pack provided with a tabbed tear-away portion at its lower end.

As shown in the drawings, the carton of the invention can be any six-sided carton (designated generally as 1) of durable material such as cardboard, plastic or the like, capable of housing articles such as cans 3. The content of the cans can vary and include cans of soft drinks, beer, fruit juice and the like stacked on their sides one on top of the other. Likewise, the number of cans within a carton can vary but the invention, more than likely, will have greatest applicability with 6- or 12-pack cartons.

The carton advantageously contains a tabbed lower section 5 which can be ripped open by pulling a tab 7 downwardly to provide an opening 9 that permits removal of cans 3 one at a time.

Figure 2:
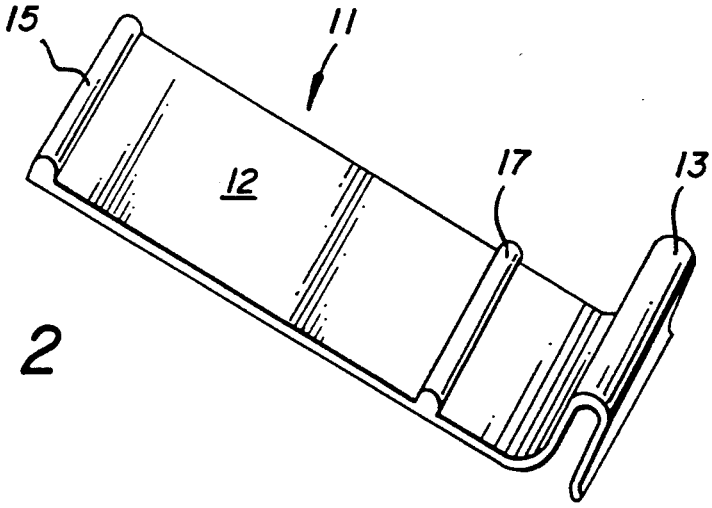
FIG. 2 is a perspective view of the member which is inserted into the carton housing the cylindrical articles.
Figure 3:
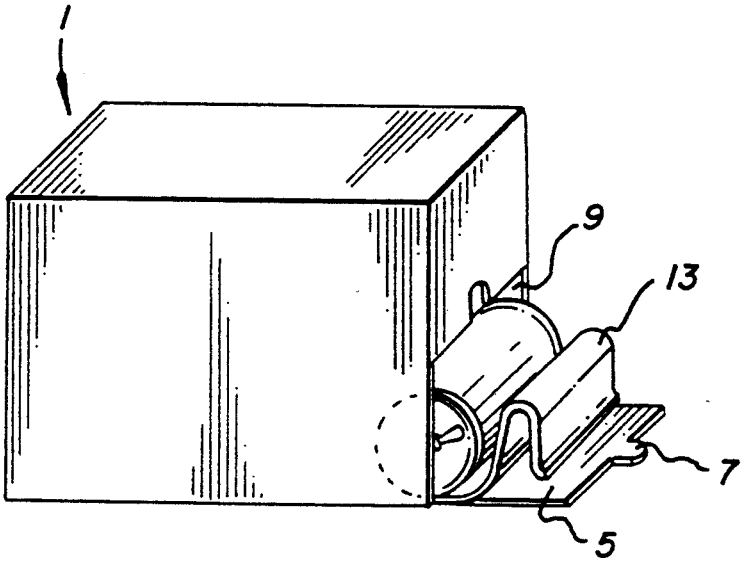
FIG. 3 is a perspective view of a twelve-can pack with the member shown in FIG. 2 fully inserted under the lowermost row of cylindrical articles in the carton.
Figure 4:
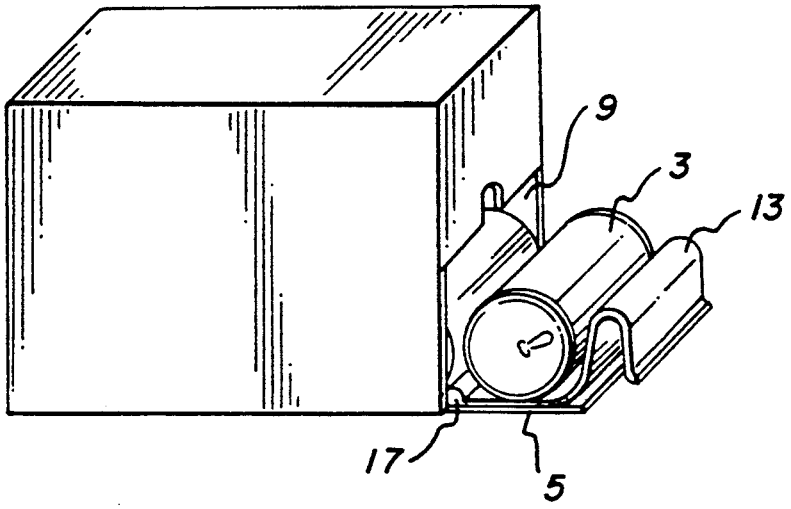
FIG. 4 is a perspective view of the member shown in FIG. 2 pulled out of the carton after being fully inserted so as to remove one cylindrical article from the carton.
Figure 5:
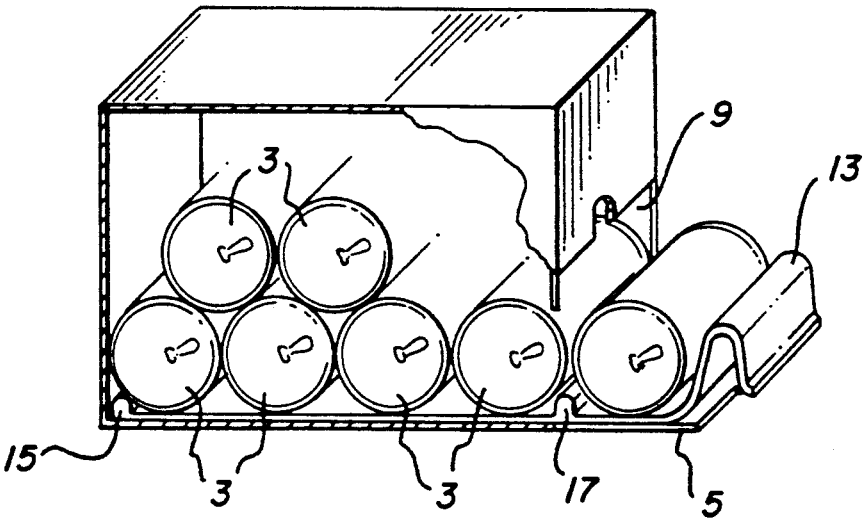
FIG. 5 is a perspective view of FIG. 3 with the side wall removed to further show the position of the inserted member and the location of cylindrical articles.

FIG. 2 shows the member, indicated generally as 11, which is slidably insertable through opening 9 under the lowermost row of cans 3. Member 11 is comprised of a curved lip 13 at one end for retaining a cylindrical article on discharge and a base 12 on which are located two upwardly projecting ridges, i.e. a first ridge 15 and second ridge 17, both of which extend the width of base 12. First ridge 15 is located on member 11 at the end opposite curved lip 13, second ridge 17 is positioned a distance from the curved lip that is slightly larger than the diameter of the can. When member 11 is fully inserted in carton 1, second ridge 17 is located a distance from the opening 9 that is slightly larger than the diameter of a can 3. First and second ridges 15 and 17 can be constructed of any desired material and can take any desired shape but they are preferably constructed of a flexible member that facilitates insertion under the lowermost row of cans yet provides abutting ridges after insertion that assists in the removal of cans 3 during operation as described below. The height of the ridge can vary so long as it permits insertion and performs its removal function. Normally, the ridges project upwardly a distance comprising 1/10 to 1/5 the diameter of the can.

In its most advantageous form, the ridges comprise elongated hollow cylinders of a suitable flexible plastic material. Illustrative of suitable flexible material from which member 11 can be constructed are polyethylene, polystyrene, polyester, polycarbonate and the like. Ridge members 15 and 17 can be constructed of like materials.

In operation, tab 7 is pulled downward to provide opening 9 in the carton 1. Member 11 is then inserted under the lowermost cans 3 in the carton, leading with the edge containing first ridge 15, until the edge hits the opposite wall of the carton. In this position, first ridge 15 rests behind and abuts the outer surface of the can 3 in the lowermost row furthermost from opening 9. Second ridge 17, on the other hand, rests behind and abuts can 3 nearest opening 9. The curved lip 13 is then grabbed and pulled outwardly withdrawing member 11 in the same direction and as a result of ridges 15 and 17, the lowermost row of cans. Withdrawal of curved lip 13 is continued for a distance that permits exit of the first can 3 from opening 9. At this point, second ridge 17 rests just behind opening 9 thereby preventing the second can in the lowermost row from rolling out opening 9. Upon removal of the withdrawn can, the process is repeated until the last can is removed.

While a preferred form of construction for carrying out the invention has been illustrated and described, the invention is capable of variation and modification without departing from the spirit of the invention. Therefore, the invention is not limited to the precise details shown but includes all variations and modifications as come within the scope of the appended claims.

What is claimed is:

1. In combination, a carton housing multiple rows of cylindrical articles stacked on their sides one on top of the other, an end of said carton having a lower section capable of forming a discharge opening that allows for lengthwise removal of a cylindrical article, and a substantially planar member slidably insertable through said opening under the lowermost row of said cylindrical articles and outwardly pullable to discharge a cylindrical article, said member having a curved lip at one end for retaining a cylindrical article on discharge, an upwardly projecting first ridge at the other end extending substantially the width of said member and when said member is fully inserted said first ridge is positioned beyond the furthest article in the lowermost row and an upwardly projecting second ridge positioned a distance from the curved lip that is slightly larger than the diameter of said cylindrical article and extending substantially the width of said member.

2. A combination according to claim 1 wherein the cylindrical articles are cans.

3. A combination according to claim 1 wherein the carton houses three rows each comprised of four cylindrical articles.

4. A combination according to claim 3 wherein the articles are cans.

5. A combination according to claim 4 wherein the cans are beer cans.

6. A combination according to claim 4 wherein the cans are soft drink cans.

7. A combination according to claim 1 wherein the member is comprised of a rigid plastic material.

8. A combination according to claim 1 wherein the first and second ridges project upwardly about 1/10 to 1/5 the diameter of the can.

9. A combination according to claim 1 wherein the lower section at the end contains a discharge opening, perforated to facilitate opening.

10. A combination according to claim 9 wherein the lower section contains a tab.

* * * * *